US007273153B1

(12) United States Patent
Kuniyoshi

(10) Patent No.: US 7,273,153 B1
(45) Date of Patent: Sep. 25, 2007

(54) BASEBALL BAT AND HELMET RACK

(76) Inventor: Brian M Kuniyoshi, 619 Isenberg St., apt. 1, Honolulu, HI (US) 96826

( * ) Notice: Subject to any disclaimer, the term of this patent is extended or adjusted under 35 U.S.C. 154(b) by 0 days.

(21) Appl. No.: 11/321,568

(22) Filed: Dec. 29, 2005

(51) Int. Cl.
*A47F 7/00* (2006.01)

(52) U.S. Cl. ..... 211/85.7; 248/303

(58) Field of Classification Search ..... 248/302, 248/303; 211/85.7, 60.1, 181.1, 106
See application file for complete search history.

(56) References Cited

U.S. PATENT DOCUMENTS 1,376,483 A * 5/1921 Thompson ..... 248/254
1,649,217 A * 11/1927 Eshleman ..... 248/444
1,841,479 A * 1/1932 Jessen ..... 248/61
1,873,297 A * 8/1932 Davenport ..... 248/312.1
2,461,071 A * 2/1949 Mettenleiter ..... 248/227.2
2,957,671 A * 10/1960 Messier ..... 248/220.43
3,036,801 A * 5/1962 Cemashko ..... 248/72
3,353,728 A * 11/1967 Freed ..... 224/243
3,393,006 A * 7/1968 Werner et al. ..... 296/214
3,627,245 A * 12/1971 Lewis ..... 248/103
3,698,563 A 10/1972 Gordon et al.
3,722,844 A * 3/1973 Baker ..... 248/302
3,779,501 A * 12/1973 Zibell ..... 248/302
3,883,934 A * 5/1975 Rochfort ..... 248/65
3,972,499 A * 8/1976 Simmons ..... 248/225.21
4,025,018 A * 5/1977 Thalenfeld ..... 248/303
4,049,126 A 9/1977 Halverson
4,566,666 A * 1/1986 Meska et al. ..... 248/558
4,629,065 A 12/1986 Braaten
4,658,907 A * 4/1987 Popp ..... 169/75
4,953,817 A * 9/1990 Mosteller ..... 248/222.51
D330,158 S * 10/1992 Mosteller ..... D8/373
5,294,005 A 3/1994 Hedges
5,556,068 A * 9/1996 Gorelik ..... 248/220.41
5,577,699 A * 11/1996 Gardner et al. ..... 248/218.3
5,582,377 A * 12/1996 Quesada ..... 248/229.12
5,626,244 A 5/1997 Mesna et al.

(Continued)

FOREIGN PATENT DOCUMENTS

GB 16966 11/2001

(Continued)

*Primary Examiner*—Carl D. Friedman
*Assistant Examiner*—Bradley H Duckworth
(74) *Attorney, Agent, or Firm*—Micheal I Kroll

(57) ABSTRACT

Apparatus 10 discloses a device having means for mounting to a structure, such as a chain link fence, providing means for hanging a baseball bat 12 and a baseball helmet 14 therefrom. The support 10 has a general planar N-shape providing a left leg 30, right leg 32 and middle leg 34 therebetween with tail end 26, extending perpendicularly at the bottom of the left leg for a short distance forming a somewhat hook-shape, with the top of the right leg extending into a U-shaped hook-like end bat holder/rest 28 in a perpendicular horizontal plane. The left leg 30 and hook-like tail end 26 form means for attachment to a chain link fence 18, while the right leg hook 28 is spaced away from the fence and has an appropriate diameter to support a baseball bat 12 by the handle end with the helmet 14 then placed over the hook-like end, which forms in a substantially horizontal plane a support surface for the helmet.

8 Claims, 14 Drawing Sheets

U.S. PATENT DOCUMENTS 5,701,998 A 12/1997 Perry et al.
5,823,360 A 10/1998 Gorosave
D400,425 S * 11/1998 Goodman et al. ..... D8/367
6,053,340 A 4/2000 Cameron
6,138,841 A 10/2000 Klein et al.
6,231,018 B1 * 5/2001 Barbieri ..... 248/302
6,254,049 B1 * 7/2001 Goehly ..... 248/302
6,375,141 B1 * 4/2002 Kettlestrings ..... 248/303
6,749,074 B1 6/2004 Hileman et al.
6,915,930 B2 7/2005 Dixon

FOREIGN PATENT DOCUMENTS

JP 11113699 4/1999
JP 20057115 1/2005

* cited by examiner

BASEBALL BAT AND HELMET RACK

BACKGROUND OF THE INVENTION

1. Field of the Invention

The present invention relates generally to sports equipment and, more specifically, to a device having means for mounting to a structure, such as a chain link fence providing means for hanging a baseball bat and a baseball helmet therefrom.

The device is an individual holder encased by a protective material with rubber end caps that will not damage the helmet or bat. Since the device is an individual holder, a plurality of said devices can be selectively spaced apart keeping all bats and helmets off of the ground making it easier for players to choose selective bats and helmets.

The device is designed to work preferably with a chain link fence having the user selectively attach the device to a desired location resulting in the device suspending the bat and helmet off of the ground and easily detached from the support as needed.

The support has a general planar N-shape providing a left leg, right leg and middle leg therebetween, extending perpendicularly at the bottom of the left leg for a short distance forming a somewhat hook-shape, with the top of the right leg extending into a U-shaped hook-like end in a perpendicular horizontal plane.

The left leg and hook-like end form means for attachment to a chain link fence, while the right leg hook is spaced away from the fence and of an appropriate diameter to support a baseball bat by the handle end with the helmet then placed over the hook-like end, which forms in a substantially horizontal plane a support surface for the helmet.

2. Description of the Prior Art

There are other support devices designed for sports equipment. Typical of these is U.S. Pat. No. 3,698,563 issued to Gordon, et al. on Oct. 17, 1972.

Another patent was issued to Halverson on Sep. 20, 1977 as U.S. Pat. No. 4,049,126. Yet another U.S. Pat. No. 4,629,065 was issued to Braaten on Dec. 16, 1986 and still yet another was issued on Mar. 15, 1994 to Hedges as U.S. Pat. No. 5,294,005.

Another patent was issued to Mesna, et al. on May 6, 1997 as U.S. Pat. No. 5,626,244. Yet another U.S. Pat. No. 5,701,998 was issued to Perry, et al. on Dec. 20, 1997. Another was issued to Gorosave on Oct. 20, 1998 as U.S. Pat. No. 5,823,360 and still yet another was issued on Apr. 25, 2000 to Cameron as U.S. Pat. No. 6,053,340.

Another patent was issued to Klein, et al. on Oct. 31, 2000 as U.S. Pat. No. 6,138,841. Yet another U.S. Pat. No. 6,749,074 was issued to Hileman, et al. on Jun. 15, 2004. Another was issued to Dixon on Jul. 12, 2005 as U.S. Pat. No. 6,915,930 and still yet another was issued on Nov. 16, 1901 to Richards as U.K. Patent No. GB 16,966. Another was issued to Mitsuo on Apr. 27, 1999 as Japanese Patent No. JP11113699 and still yet another was issued on Jan. 13, 2005 to Takashi as Japanese Patent No. JP2005007115.

U.S. Pat. No. 3,698,563

Inventor: George E. Gordon, et al.

Issued: Oct. 17, 1972

A portable storage rack is disclosed including a ball box for storage of baseballs, a plurality of bat retaining members extending from the ball box for storing bats, and a plurality of fingers extending from the ball box and providing hooks for the storage of baseball helmets or gloves. Additional hooks are provided on the rack to permit he entire structure to be readily attached and detached from a chain link fence or similar structure.

U.S. Pat. No. 4,049,126

Inventor: Lance K. Halverson

Issued: Sep. 20, 1977

A portable bat rack having a first configuration attachable to a fence for the storage of baseball bats and a more compact second configuration of smaller dimensions for transporting the bat rack. The bat rack is front suspended adjacent each end minimizing tilting by partially equalizing the moments caused by the weight of the bats. A shelf-like first support bar is provided with individual forward opening recesses spaced laterally to independently receive each bat in a substantially vertical position. A bat receiving second support bar is provided and is detachably connected to the first support bar thereby allowing end-to-end coplanar abutting of the adjacent support bars in first configuration. A pair of hangers are pivotally attached to the first support bar near each end for attaching the bat rack to an open weave fence. A third hanger is pivotally attached to the outward end of the second support bar. Each hanger is rotatable against its respective support bar in the second configuration thereof. The hinge is separable allowing the first support bar to be used independently without the second support bar in the event a lesser amount of bat stowage is required.

U.S. Pat. No. 4,629,065

Inventor: Donald L. Braaten

Issued: Dec. 16, 1986

A baseball equipment holder comprising an elongate tubular housing that can have a diameter sufficient to accommodate a plurality of playing balls in side-by-side relationship. A plurality of longitudinally aligned openings open to the housing to retain a plurality of baseball bats. Hanger members extend from the housing for suspending items of baseball equipment. The housing is connectable to upright structure such as a chain link fence.

U.S. Pat. No. 5,294,005

Inventor: Robert S. Hedges

Issued: Mar. 15, 1994

A portable modular sports equipment rack includes elongated telescoping tubular mounting members for accommodating a number of different types of hooks specifically adapted to receive different types of softball or baseball equipment, including at least fielding gloves, batting helmets and bats. Tubular spacer elements maintain a desired space between different pieces of equipment. A plurality of aligned apertures in a line along the tubular mounting members allow the length of the rack to be adjusted easily and is locked into the desired length by a snap button fastener engaged in two aligned apertures in the telescoping members. Aligned apertures through both side walls of the tubular members along a diameter of a cross section of the tubes adjacent to their ends allow the rack to be conveniently suspended from a chain link fence by a clevis pin through the apertures. The rack allows equipment to be stored at games, during travel to and from games, and at a remote storage cite, such as a locker room, if desired.

U.S. Pat. No. 5,626,244

Inventor: Larry D. Mesna

Issued: May 6, 1997

A bat rack having a generally L-shaped elongated member with a series of recesses adapted to receive the handles of baseball bats. The bat rack includes two spaced apart hooks, one of which is fixed to the member while the other is laterally moveable to adjust the spacing between the two hooks and thereby facilitate the rack's engagement with the wire of an ordinary chain link fence. The hooks are constructed to have a U-shaped cross-section in which the base of the U is folded at about a 45 degree angle to better align it with the wire of the chain link fence.

U.S. Pat. No. 5,701,998

Inventor: Eric J. Perry

Issued: Dec. 30, 1997

A bat handle cover for encasing the grip area of a bat handle and for suspending the bat by a chain and clasp from a suspending structure. The cover may be made of stiff material, and include either a number of locking balls, a ring or a pair of U-shaped latches near the inside top of the cover, which grasp the bat handle just below the enlarged butt end or head of a conventional baseball bat. The cover may be made of flexible material, and include a necked-in portion which engages the bat. The flexible cover may have a full length slit closed by hook and loop fasteners about the bat handle, or a zipper closure running most of the length of the cover. A lower, open end of the cover may include a seal, to prevent water, moisture and/or debris from entering the interior of the cover.

U.S. Pat. No. 5,823,360

Inventor: Daniel R. Gorosave

Issued: Oct. 20, 1998

A device (10) for holding items, such as sports equipment, beverage containers, clothing, jewelry and etc., includes a support member (27). The support member includes a connector (28) at its upper end for connecting the device to another structure, such as a chain link fence (25), and supporting the device from this structure. The device additionally includes a first receptacle (23) connected to the support member for receiving and retaining a beverage container (12). The device further includes a second receptacle (16), (38) or (64) connected to the support member for receiving and retaining a ball or balls (14), (40) or (66). In one embodiment, a pair of prongs (72) and (74) cantilever from the lower end of the support member for holding sports equipment, such as a bat (76).

U.S. Pat. No. 6,053,340

Inventor: John L. Cameron

Issued: Apr. 25, 2000

A rack for organizing, protecting, and storing various sports equipment has a backboard, a receptacle for holding a beverage container, at least one equipment hook, a bat holder hook, at least one flexible member such as a securing strap, an optional hanging hole, and a decorative area. The backboard supports the other components and contains points of attachment for the securing strap. The receptacle stores a beverage container in an upright position. The equipment hook allows for hanging sports or related equipment such as baseball gloves or baseball hats. The bat holder hook allows for holding a baseball bat or other equipment such as a jacket or other items of clothing. The flexible member such as a securing strap secures the rack to a fixture such as a chain link fence, wall or other support. The hanging hole allows the rack to be secured to a pre-existing hook or protuberance if the securing straps cannot be used. The decorative area allows for displaying custom graphic matter such as logos or names.

U.S. Pat. No. 6,138,841

Inventor: Richard B. Klein

Issued: Oct. 31, 2000

A sports equipment rack for supporting sports equipment in an angular manner. A pair of side frame members having an elongate main body section and a plurality of support arms projecting outwardly and upwardly from each main body section. Pairs of retaining bars are positioned on said support arms and are aligned in a plane forming an acute angle with respect to vertical, to thereby support thereon sports equipment in an angular manner, with the equipment directed downwardly toward a vertical surface upon which the shoe rack is placed. The support arms, upon opposite side frames, traverse side sections of the equipment to form a barrier against lateral movement of the equipment. Additionally, each side frame member includes a unique prong for hanging the rack on an upright surface such as a door. A pair of cross bars are positioned between the opposing side members. A plurality of outwardly opening hooks are slidably attached to said pair of cross bars. Further, a pair of unique bat holding members are fastened to at least one of the support arms.

U.S. Pat. No. 6,749,074

Inventor: John Hileman

Issued: Jun. 15, 2004

A portable rack for arranging and storing baseball bats, balls, batting hats and related baseball equipment. The storage rack is supported on a wall surface with extensible and pivotal deployable equipment engaging extensions for receiving baseball equipment. Clip assemblies allow for selective attachment and removal from a wall-supporting surface.

U.S. Pat. No. 6,915,930

Inventor: Jerry J. Dixon

Issued: Jul. 12, 2005

A hanger for hanging one or more hats, particularly baseball-style caps, from a support member. The cap hanger has an upper portion with a hook, a middle portion suitable for displaying information and a lower portion having a hanger body with one or more hanger sections. The hanger sections are configured to receive and retain the back portion, either the back side of the cap or the strap or band, whether adjustable or not, of a cap in a cap receptacle and suspend the cap in a generally downward direction. The hanger sections can have an upper channel and a plurality of lower channels separated by a protruding member and a shaped narrowed section to hold the cap in the cap hanger. The cap hanger can also have one or more brim clips, separately or in combination with hanger sections, for receiving and retaining the brim of a cap.

U.K. Patent Number GB16,966

Inventor: Emily Georgina Richards

Issued: Nov. 16, 1901

The invention consists in providing of metal or other suitable material a device composed of a suitably formed hook or its equivalent adapted to receive and support a hat, and be retained in any convenient manner upon the backs of chairs, seats, forms or the like in such a position as to be readily accessible without being in the way, the said hook having combined therewith a suitable hinged or other spring clip, preferably so arranged that it will remain in an open position while a hat or the like is being placed upon the hook, and grip and retain the said hat when closed, which obtains that by such disposal of hats or the like beyond danger of becoming soiled and without trouble to the owners thereof, the inconveniences and objections before mentioned are entirely obviated.

Japanese Patent Number JP11113699

Inventor: Kisaki Mitsuo

Issued: Apr. 27, 1999

Problem to be solved: To provide a hanging and anchoring tool for displaying rod-like goods by which rod-like goods such as baseball bats can be freely easily removably hung and displayed and a purchaser can easily confirm the goods by taking them in hand and which exhibits excellent appearance and by which the surfaces of goods are hardly damaged.

Solution: A hanging and anchoring tool 2 for displaying is made of a flexible belt-like thin sheet 10 (10*a*, 10*b*, 10*c*) and is wound on one end of the rod-like goods 4 below the projected part projecting in the radial direction and both ends 10*a* and 10*b* are piled up and are bonded with a stapler 12. The intermediate part 10*c* is curved and formed into a truncated cone-like cylindrical part 14 for anchoring the goods and piled both end parts 10*a* and 10*b* are extended upward from the cylindrical part 14 and a anchor hole 18 provided on this extended part 16 is hooked to a hook fitted on a wall face, etc. In addition, at least one end part 10*a* piled inside is formed in a wide width wherein an area A on which an explanation of the goods can be written is ensured.

Japanese Patent Number JP2005007115

Inventor: Kato Takashi

Issued: Jan. 13, 2005

Problem to be solved: To provide a holder capable of displaying a bat as a part of the interior accessory by hanging it on the wall with sufficient consideration in safety.

Solution: A bat can be hung laterally without allowing a shift by using the weight of the head of the bat by installing bat holding members 2*a*, 2*b* having a semicircle recess in a back plate 1 in positions staggered vertically and horizontally. By repeating this pattern by extending the back plate, the bats as many as the number of the patterns can be held and displayed.

While these apparatus may be suitable for the purposes for which they were designed, they would not be as suitable for the purposes of the present invention, as hereinafter described.

SUMMARY OF THE PRESENT INVENTION

The present invention discloses a device having means for mounting to a structure, such as a chain link fence providing means for hanging a baseball bat and a baseball helmet therefrom. The support has a general planar N-shape providing a left leg, right leg and middle leg therebetween with tail end, extending perpendicularly at the bottom of the left leg for a short distance forming a somewhat hook-shape, with the top of the right leg extending into a U-shaped hook-like end bat holder/rest in a perpendicular horizontal plane. The left leg and hook-like tail end form means for attachment to a chain link fence, while the right leg hook is spaced away from the fence and has an appropriate diameter to support a baseball bat by the handle end with the helmet then placed over the hook-like end, which forms in a substantially horizontal plane a support surface for the helmet.

A primary object of the present invention is to provide means for suspending a baseball bat and helmet off the ground.

Another object of the present invention is to provide a support substantially having an N-shape with the left leg extending hook-like with the right leg extending in a transverse horizontal plane also hook-like.

Yet another object of the present invention is to provide a support having means for engaging the structure of a chain link fence.

Still yet another object of the present invention is to provide a support having a surface encompassed by a protective member.

Another object of the present invention is to provide a support having ends caps serving as protective elements to keep from damaging the articles being supported.

Yet another object of the present invention is to provide a support having means for holding a baseball bat until selectively released.

Still yet another object of the present invention is to provide a support having means for holding a baseball helmet until selectively released.

Another object of the present invention is to provide a support that can be used in conjunction with other supports to keep baseball bats and helmets off of the ground.

Yet another object of the present invention is to provide an individual support for a baseball bat and helmet that can be selectively spaced from other said supports.

Additional objects of the present invention will appear as the description proceeds.

The present invention overcomes the shortcomings of the prior art by providing a device having means for mounting to a structure, such as a chain link fence providing means for hanging a baseball bat and a baseball helmet therefrom.

The device is an individual holder encased by a protective material with rubber end caps that will not damage the helmet or bat. Since the device is an individual holder, a plurality of said devices can be selectively spaced apart keeping all bats and helmets off of the ground making it easier for players to choose selective bats and helmets.

The support has a general planar N-shape providing a left leg, right leg and middle leg therebetween, extending perpendicularly at the bottom of the left leg for a short distance forming a somewhat hook-shape, with the top of the right leg extending into a U-shaped hook-like end in a perpendicular horizontal plane.

The left leg and hook-like end form means for attachment to a chain link fence, while the right leg hook is spaced away from the fence and of an appropriate diameter to support a baseball bat by the handle end with the helmet then placed over the hook-like end, which forms in a substantially horizontal plane a support surface for the helmet.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
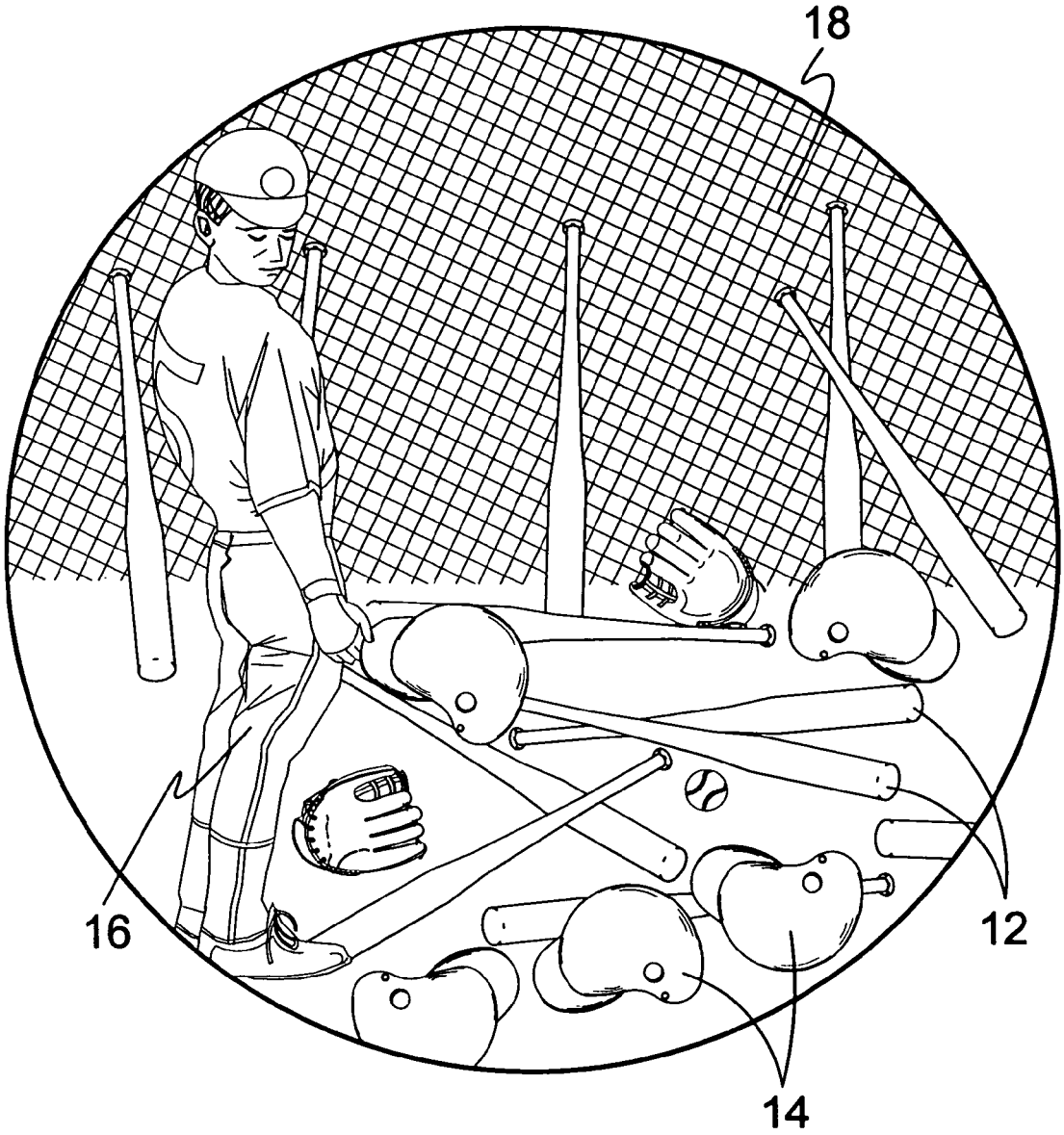
FIG. 1 (PRIOR ART)
FIG. 1 is an illustrative view of prior art.

With regard to reference numerals used, the following numbering is used throughout the drawings.

10 present invention
12 bat
14 helmet
16 batter
18 fence
20 cover
22 end cap
24 arch
26 tail end
28 bat holder/rest
30 left leg
32 right leg
34 middle leg
36 knob

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of prior art. During a baseball game, bats 12 and helmets 14 are usually thrown and scattered about the ground in an unorganized fashion. This presents a significant safety hazard. It is necessary that the bats 12 and helmets 14 be positioned for ready accessibility to a batter 16 so that he might quickly grab and remove a bat and helmet when time is right. The present invention overcomes this problem by providing a portable bat and helmet rack attachable to a fence 18.

Figure 2:
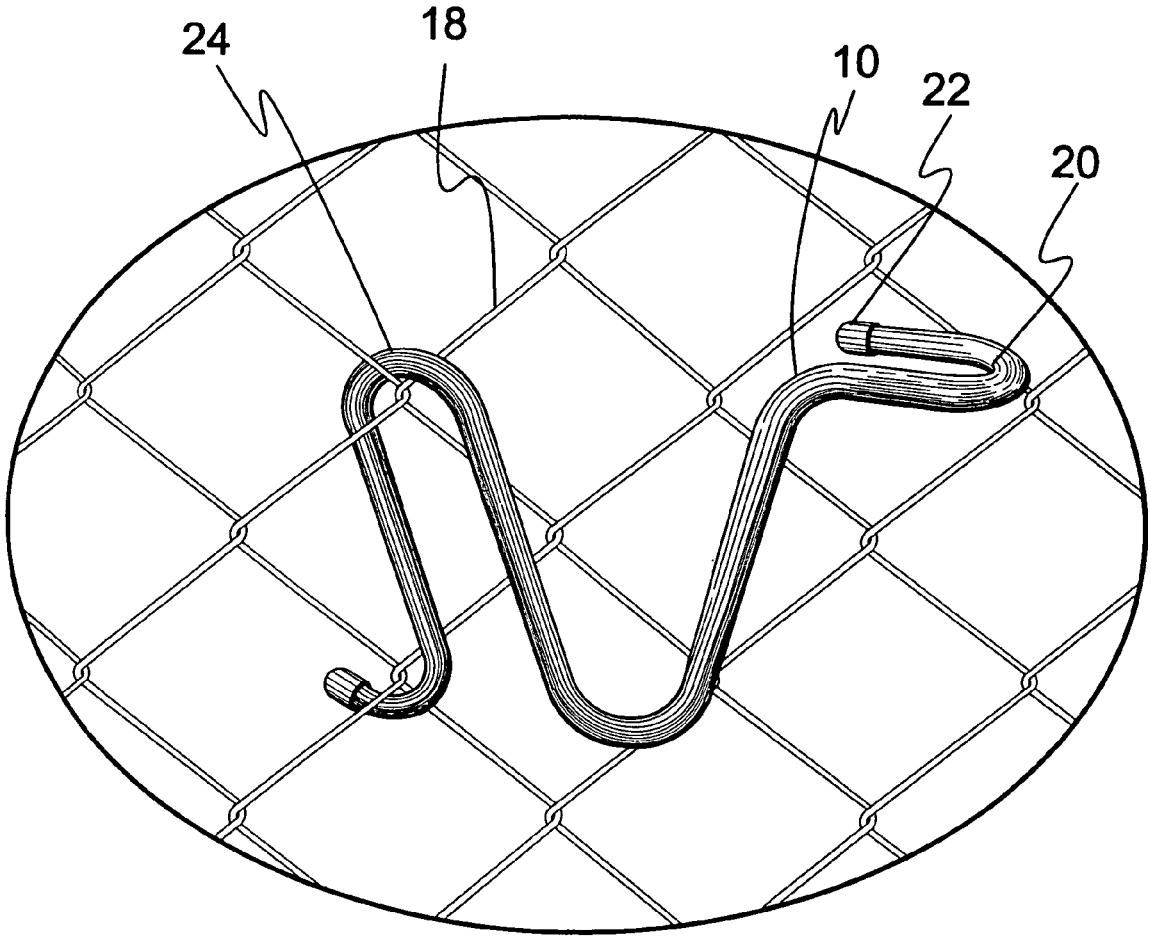
FIG. 2 is an illustrative view of the present invention in use.

Turning to FIG. 2, shown therein is an illustrative view of the present invention 10 in use. The present invention 10 discloses a portable bat and helmet rack attachable to a chain link fence 18. The bat and helmet rack 10 may be made from a bar of material and is front suspended from a chain link fence 18 from a hook or arch portion 24 at the top of the device, minimizing tilting and equalizing movement. The device 10 is a personal, light weight rack allowing the user to keep batting equipment organized. This will prevent overcrowding of players in one area, usually near fence openings or gates. The rack 10 helps organize bats and helmets by keeping them off the ground and benches while still being readily available to a batter. The device 10 is covered by polymeric cover tubing 20 having rubber end caps 22.

Figure 3:
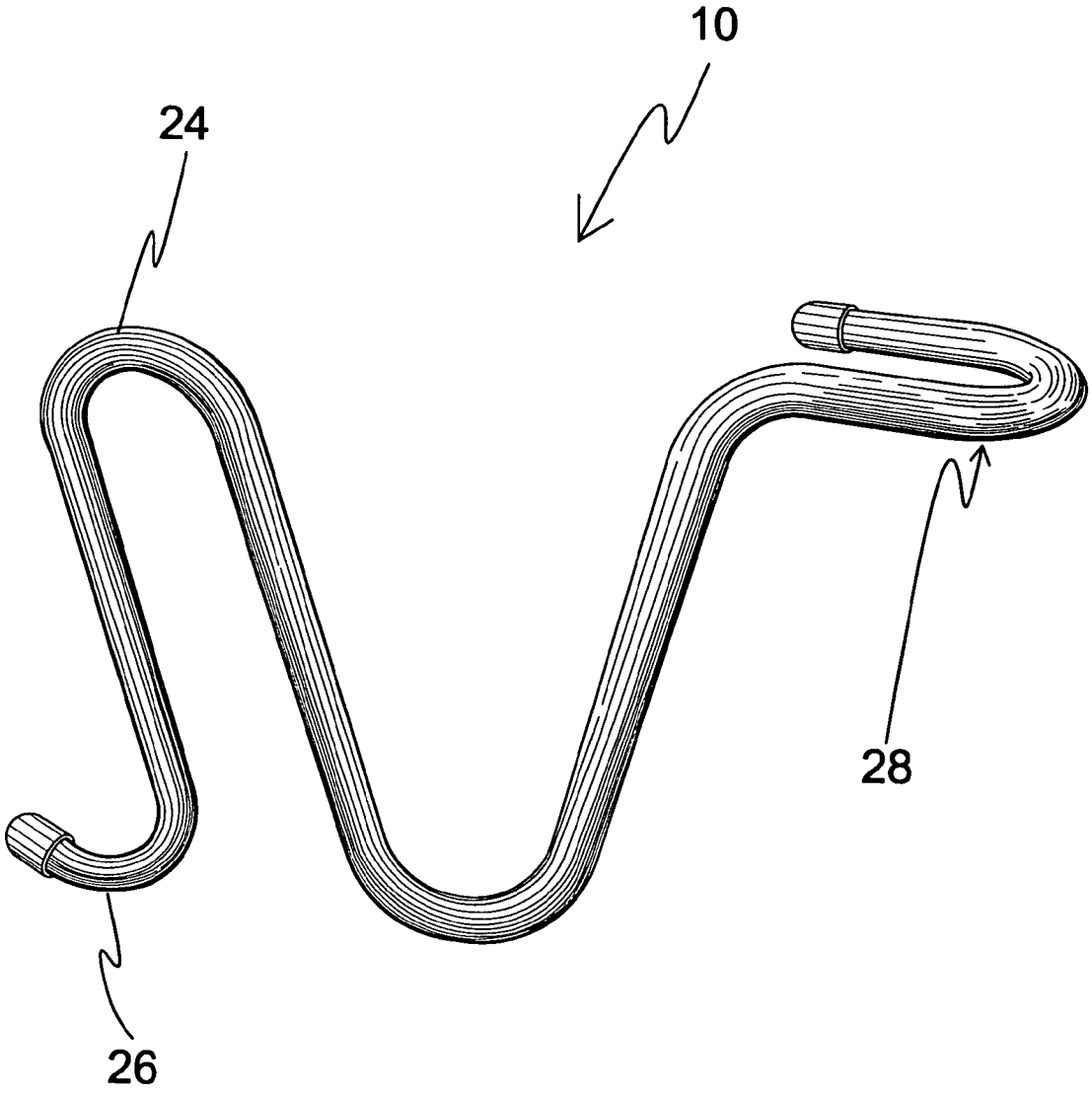
FIG. 3 is a perspective view of the present invention.

Turning to FIG. 3, shown therein is a perspective view of the present invention 10. The present invention 10 discloses a device having means for mounting to a structure, such as a chain link fence providing means for hanging a baseball bat and a helmet therefrom. The device 10 is an individual holder encased by a protective material with rubber end caps that will not damage the helmet or bat. Shown are the arch 24 which supports the weight of the equipment, sits in the bottom corner of the diamond shaped opening in the fence, and also helps the tail to stabilize and reduce horizontal movement, the tail end 26 of the bat holder hooks into the top corner of the diamond shaped opening in the fence and greatly reduces horizontal movement, and the bat holder/rest 28 is where the knob of the bat rests and must be level or slightly angled down an effective amount so the bats rest inside the hook. Tail end 26 extends toward the fence away from the bat holder/rest 28 and is disposed in substantially the vertical plane and the bat holder/rest is disposed in substantially the horizontal plane.

Figure 4:
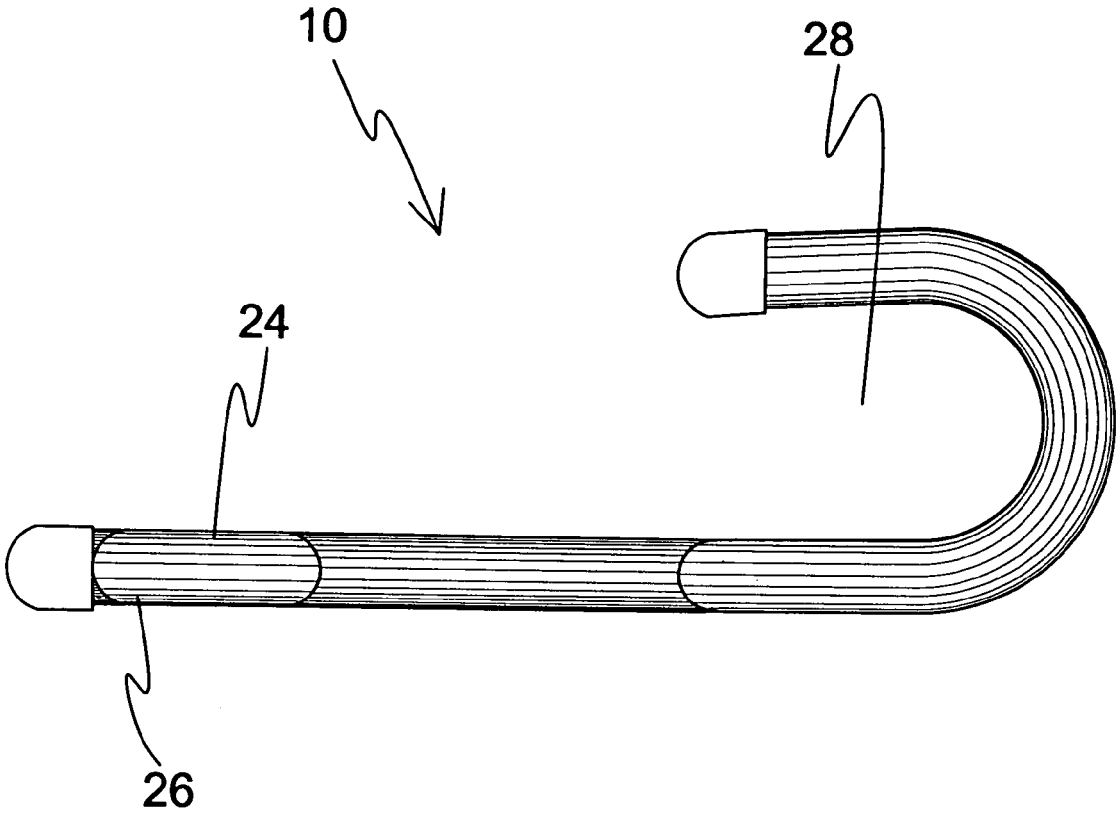
FIG. 4 is a top view of the present invention.

Turning to FIG. 4, shown therein is a top view of the present invention 10. The present invention 10 comprising a device that mounts to a chain link fence providing means for hanging a baseball bat and a helmet therefrom. The device 10 is an individual holder encased by a protective material with rubber end caps that will not damage the helmet or bat. Other previously disclosed elements are also shown.

Figure 5:
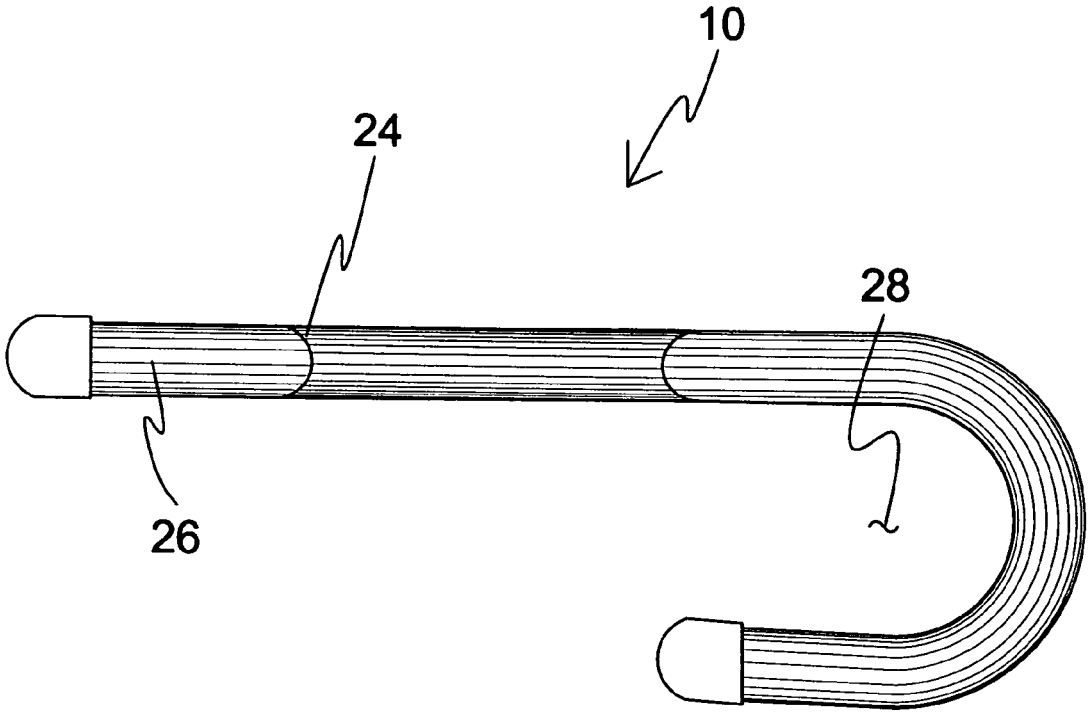
FIG. 5 is a bottom view of the present invention.

Turning to FIG. 5, shown therein is a bottom view of the present invention 10. Shown is a bottom view of the present invention 10 disclosing a device having means for mounting to a chain link fence providing means for hanging a baseball bat and a helmet therefrom. Other previously disclosed elements are also shown.

Figure 6:
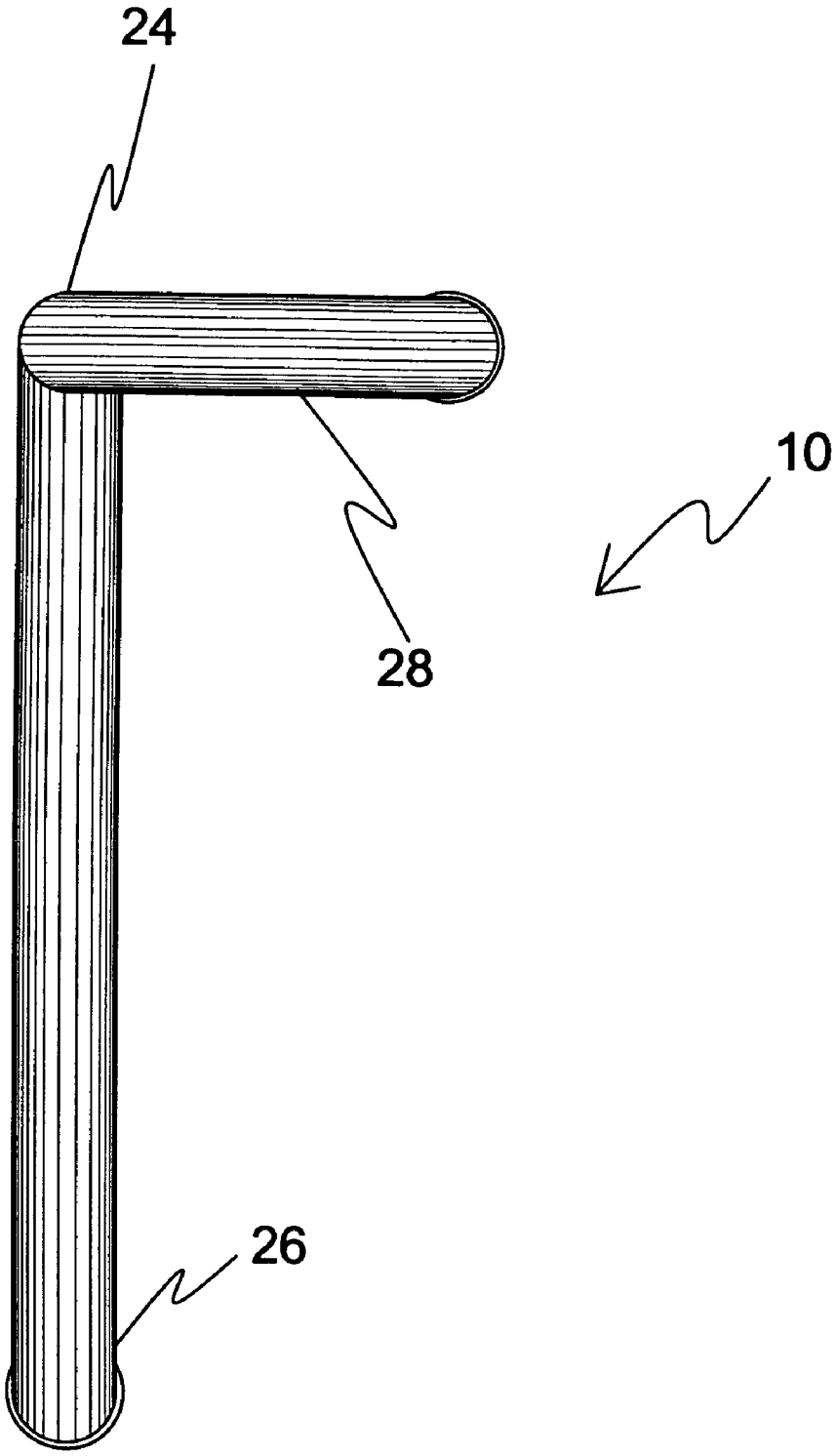
FIG. 6 is a frontal view of the present invention.

Turning to FIG. 6, shown therein is a frontal view of the present invention 10. Shown is a frontal view of the present invention 10 disclosing the device mounts to a chain link fence providing means for hanging a baseball bat and a helmet therefrom. The device 10 is an individual holder encased by a protective material with rubber end caps that will not damage the helmet or bat. Other previously disclosed elements are also shown.

Figure 7:
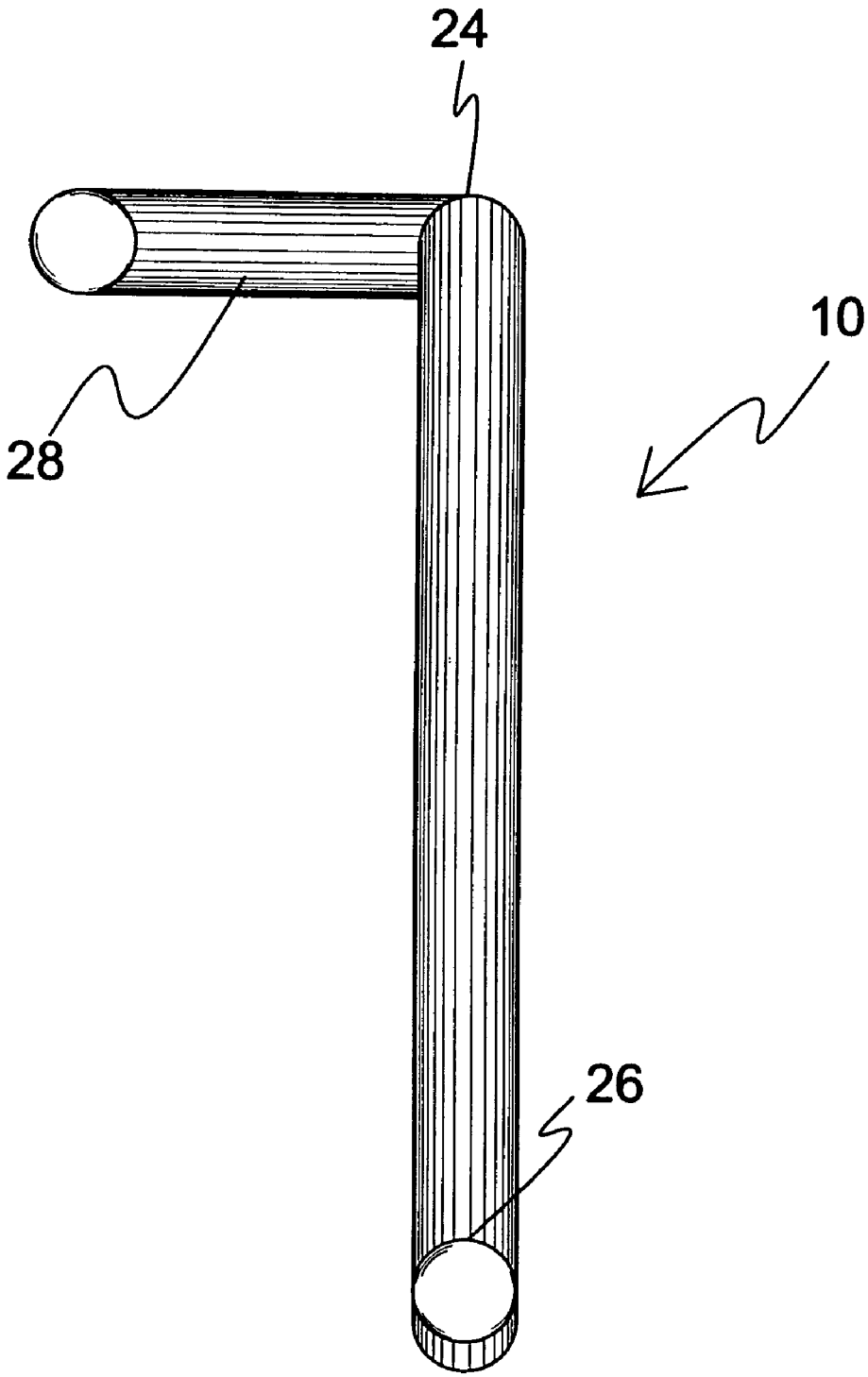
FIG. 7 is a rear view of the present invention.

Turning to FIG. 7, shown therein is a rear view of the present invention 10. Shown is a rear view of the present invention 10 mountable to a chain link fence providing means for hanging a baseball bat and a helmet therefrom. The device 10 is an individual holder encased by a protective material with rubber end caps that will not damage the helmet or bat. Other previously disclosed elements are also shown.

Figure 8:
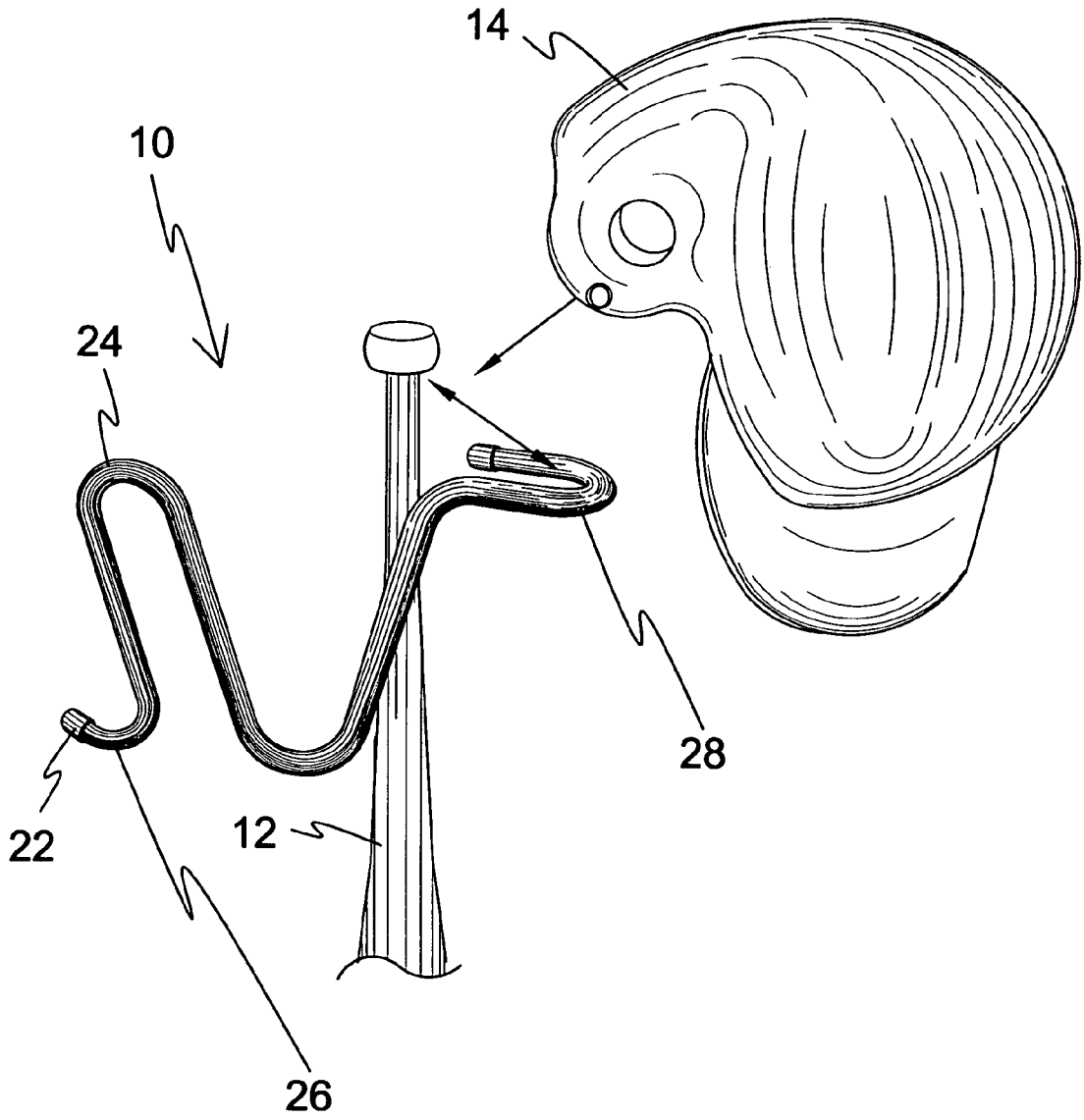
FIG. 8 is a perspective view of the present invention.

Turning to FIG. 8, shown therein is a perspective view of the present invention 10. The device of present invention 10 is designed to work preferably with a chain link fence having the user selectively attach the device to a desired location resulting in the device suspending a baseball bat 12 and helmet 14 off of the ground and easily detached from the support as needed. Other previously disclosed elements are also shown.

Figure 9:
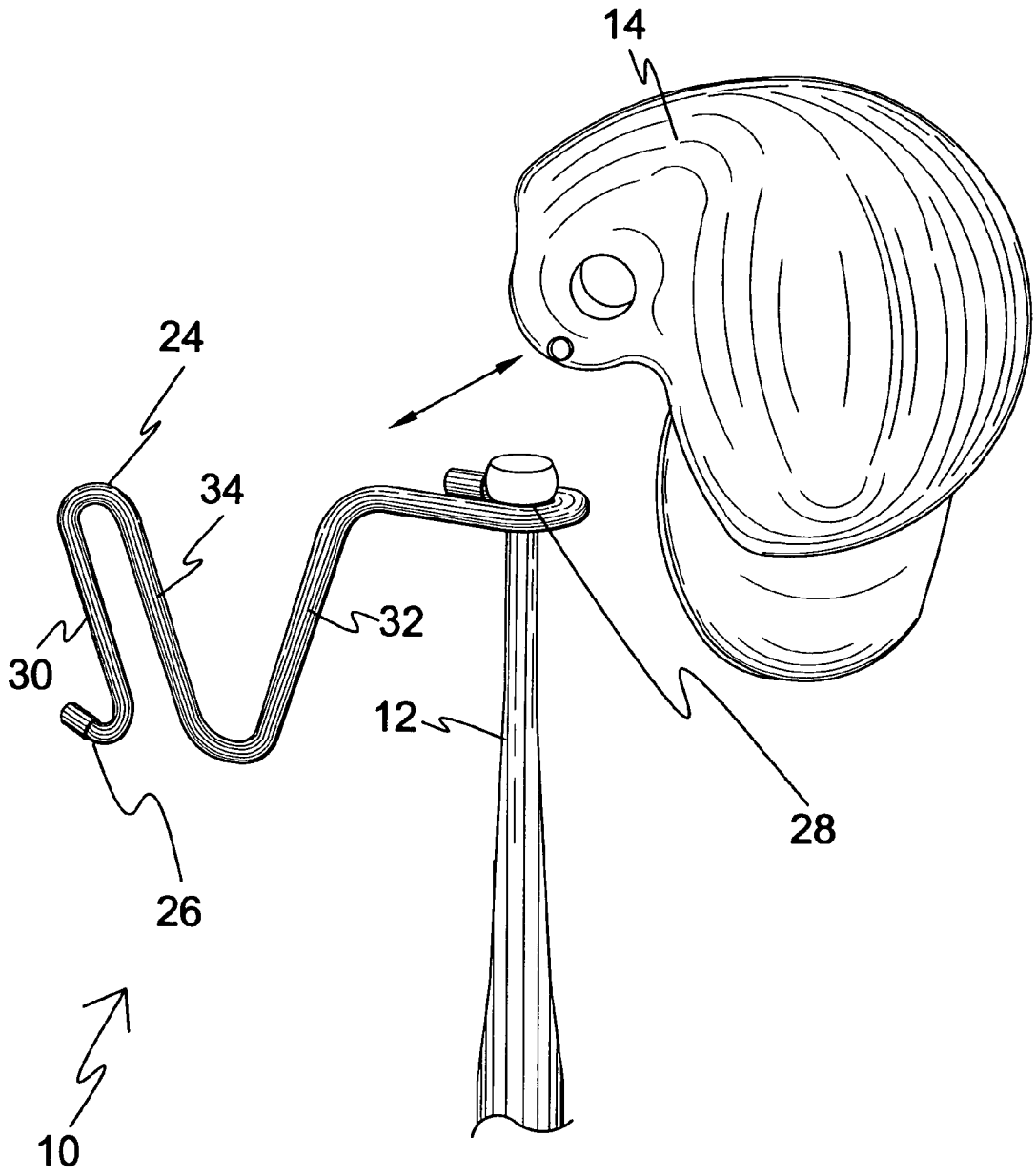
FIG. 9 is a perspective view of the present invention.

Turning to FIG. 9, shown therein is a perspective view of the present invention 10. The support 10 has a general planar N-shape providing a left leg 30, right leg 32 and middle leg 34 therebetween, the tail end 26 extends perpendicularly at the bottom of the left leg for a short distance forming a somewhat hook shape, with the bat holder/rest 28 disposed on the top of the right leg extending into a U-shape hook-like end in a perpendicular horizontal plane. The left leg 30 and hook-like end 26 forms means for attachment to a chain link fence, while the right leg hook or bat holder/rest 28 is spaced away from the fence an effective distance and of an appropriate diameter to support a baseball bat 12 by the handle end with the helmet 14 then placed over the hook-like end, which forms in a substantially horizontal plane support surface for a helmet. Arch 24 is also shown.

Figure 10:
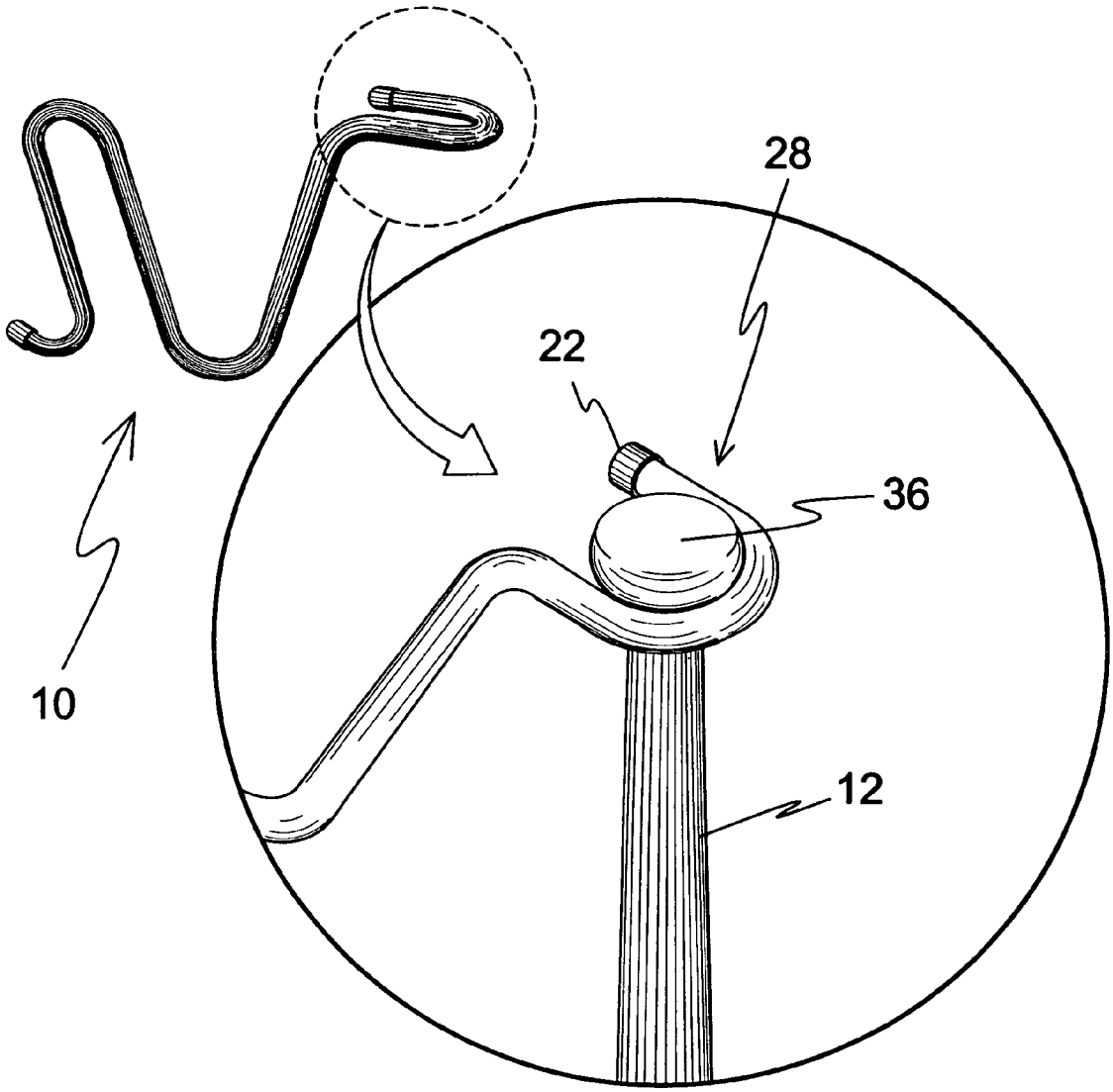
FIG. 10 is a detailed view of the present invention.

Turning to FIG. 10, shown therein is a detailed view of the present invention 10. Shown is detailed view of the baseball bat resting hook or bat holder/rest 28 designed with an appropriate diameter to support a baseball bat 12 by the knob 36 of the handle end and allowing a helmet to be placed over the hook-like end. End cap 22 is also shown. Bat holder/rest 28 has a diameter slightly less than knob 36 and slightly greater than the handle of bat 12.

Figure 11:
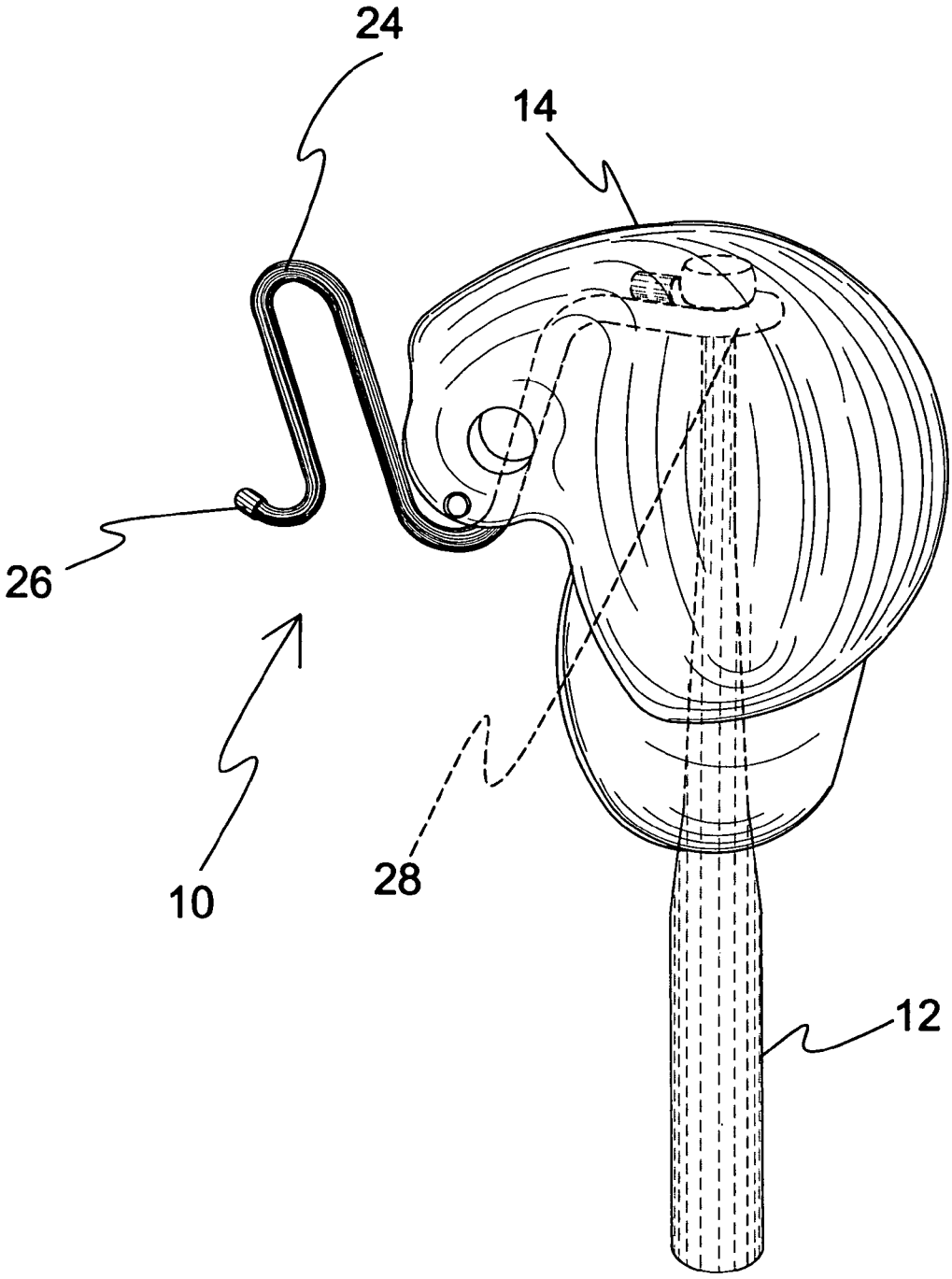
FIG. 11 is a perspective view of the present invention.

Turning to FIG. 11, shown therein is a perspective view of the present invention 10. The portable bat and helmet rack 10 is attachable to a chain link fence. The bat and helmet rack 10 is front suspended from a chain link fence from an arch 24 or hook portion at the top of the device, minimizing tilting and equalizing movement. The device 10 is a personal, light weight rack allowing the user to keep batting equipment organized. The rack helps organize bats 12 and helmets 14 by keeping them off the ground and benches while still being readily available to a batter. Other previously disclosed elements are also shown.

Figure 12:
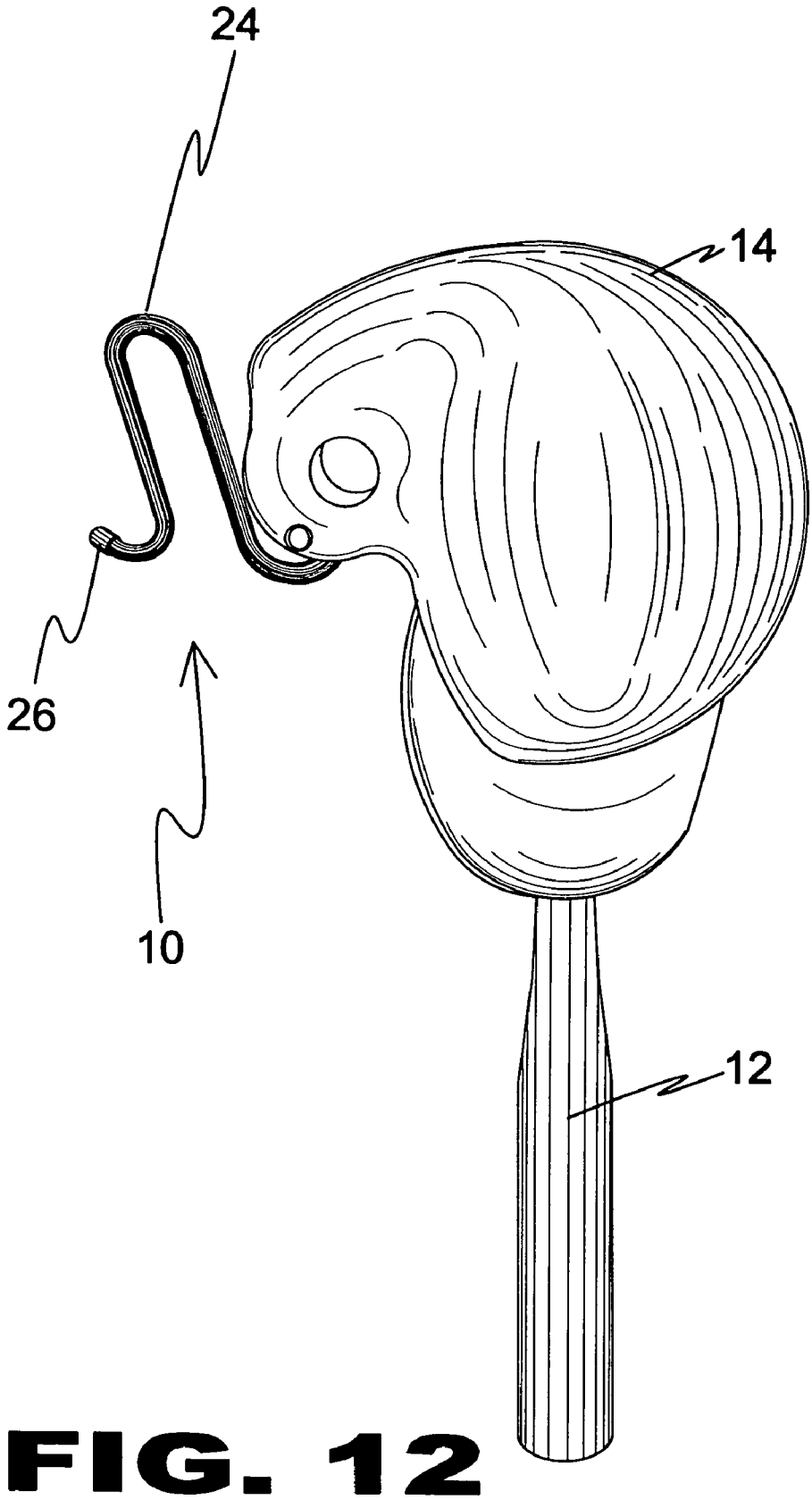
FIG. 12 is a perspective view of the present invention having baseball bat and helmet mounted thereon.

Turning to FIG. 12, shown therein is a perspective view of the present invention 10 having baseball bat 12 and helmet 14 mounted thereon. The present invention 10 is a portable device designed to mount to a chain link fence and provide means for hanging a baseball bat 12 and helmet 14 therefrom. Other previously disclosed elements are also shown.

Figure 13:
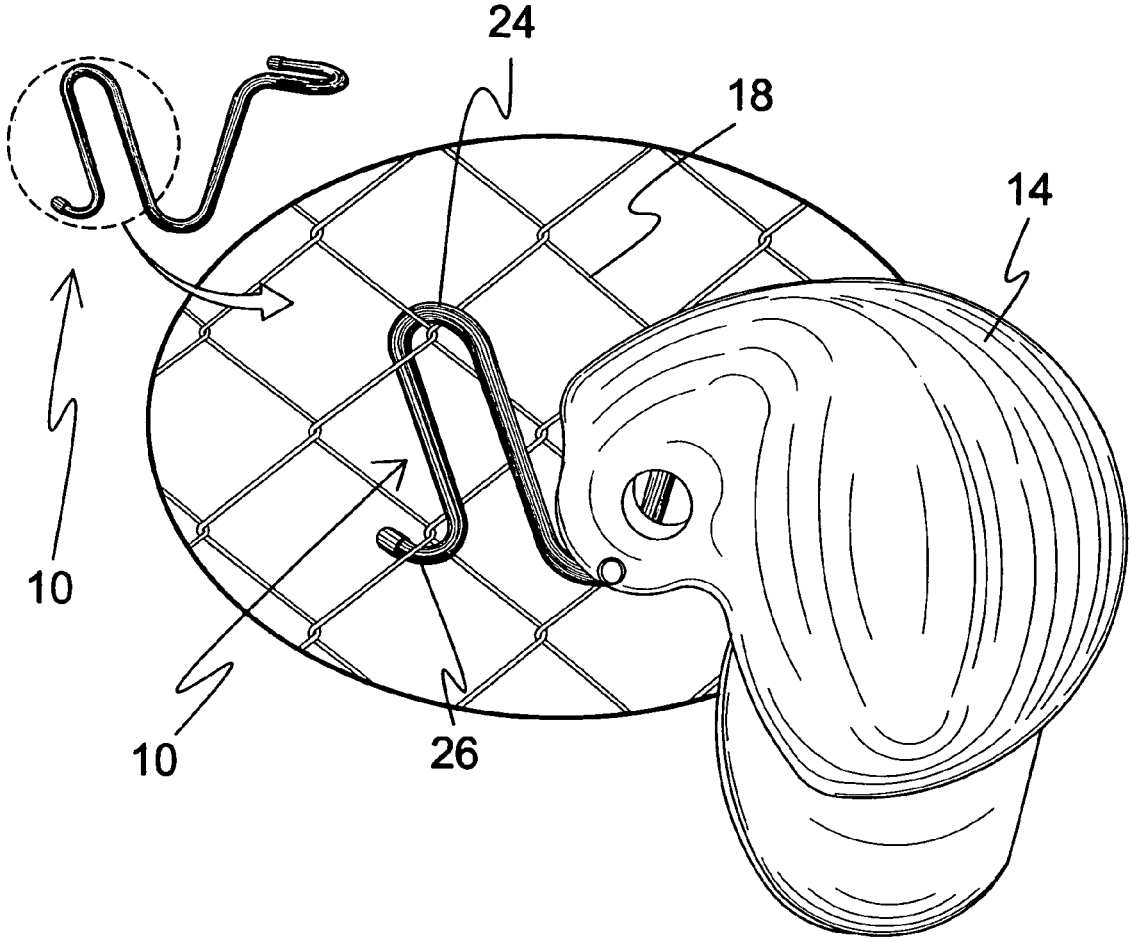
FIG. 13 is a detailed view of the present invention.

Turning to FIG. 13, shown therein is a detailed view of the present invention 10. The portable bat and helmet rack 10 is suspended from a chain link fence 18 from a hook or arch 24 portion at the top and tail end 26 at the bottom of the device, minimizing tilting and equalizing movement. Helmet 14 is also shown.

Figure 14:
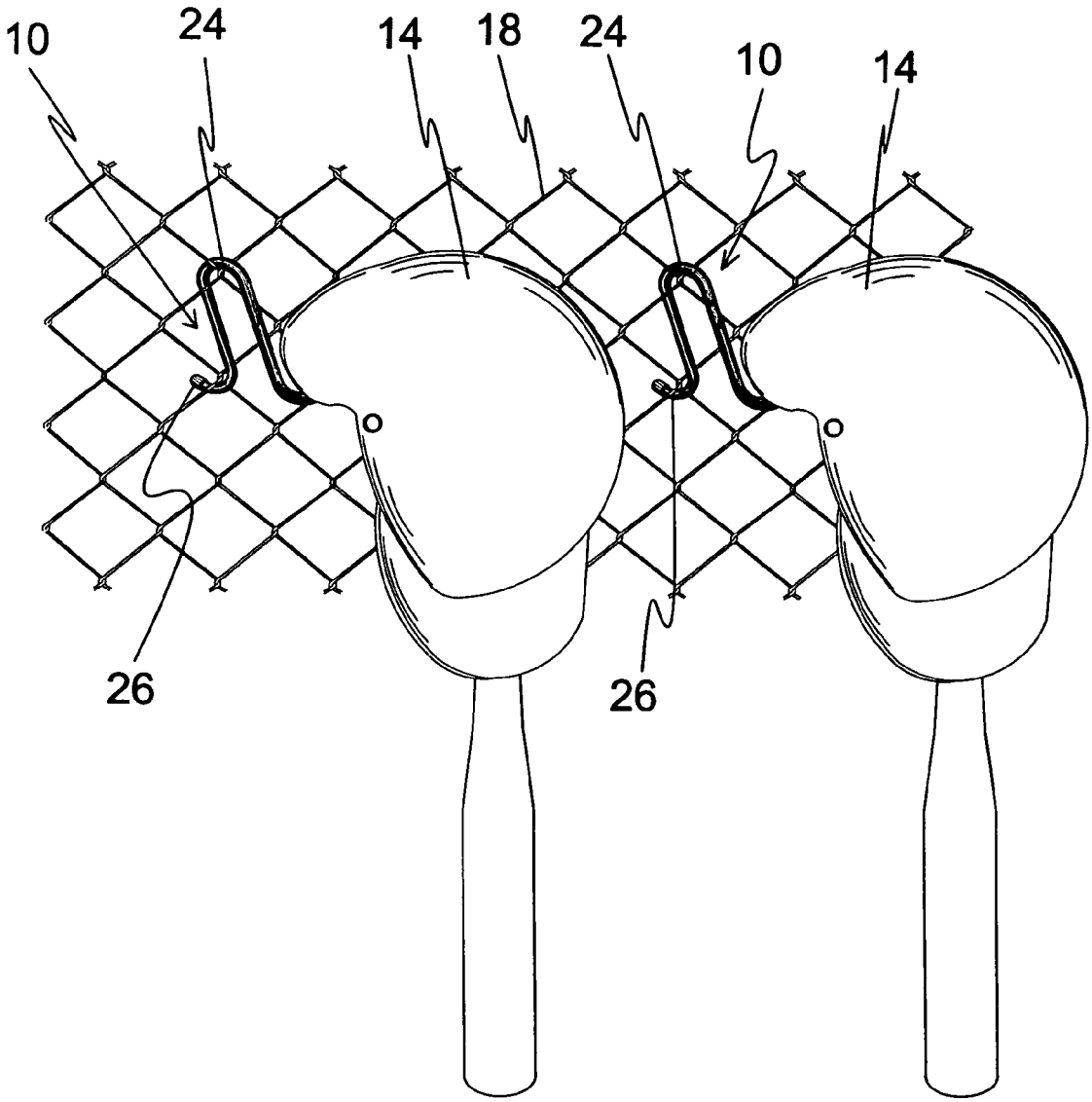
FIG. 14 is an illustrative view of the present invention.

Turning to FIG. 14, shown therein is an illustrative view of the present invention 10. Shown is a plurality of baseball bat and helmet holding devices of the present invention 10. The portable bat and helmet racks 10 are suspended from a chain link fence 18 from a hook like arch 24 at the top of the device and further secured to the chain link fence from the tail end 26 of the device, minimizing tilting and equalizing movement. Helmets 14 are also shown.

I claim:

1. An apparatus comprising the combination of a baseball bat, a helmet, a rack suporting said baseball bat and helmet, and a chain link fence, the fence having a plurality of interconnected diamond shaped openings formed by interlocking elements each opening have top and bottom corners, the rack comprising:

a) a rod of circular cross section formed into left, middle and right legs; said middle and right legs forming a V-shape with an upwardly directed opening, said left and middle legs substantially parallel with each other, with an arch portion at top ends thereof joining said left and middle legs and forming a downwardly directed opening, a free end of said left leg forming a hook shaped tail end, and a free end of said right leg shaped into a U-shaped bat holder/rest;

b) with said arch portion of said rack member engaging a top corner of one of said plurality of diamond shaped openings of said chain link fence;

c) with said tail end of said rack member hooking on a bottom corner of said diamond shaped opening of said chain link fence so that said U-shaped bat holder/rest is in a horizontal plane spaced away from said chain link fence;

d) with a handle end of said bat nestled for support in said U-shaped bat holder/rest and said helmet resting on said handle end of said bat thereby suspending said bat and helmet off a ground surface.

2. The apparatus of claim 1, wherein said rack member is made of a rod being substantially N-shaped.

3. The apparatus of claim 2, wherein said hook shaped tail end lies substantially in a vertical plane.

4. The apparatus of claim 3, wherein said hook shaped tail end extends substantially perpendicularly away from said left leg toward the fence and away from said right leg so that horizontal movement of said rack member is reduced.

5. The apparatus of claim 4, wherein said U-shaped bat holder/rest has an opening greater than the handle of the bat and less than a knob of the handle of the bat so that the bat is retained in said holder/rest.

6. The apparatus of claim 5, wherein said bat holder/rest is spaced a sufficient distance away from the fence so that the bat and the helmet can be disposed on said bat holder/rest simultaneously.

7. The apparatus of claim 6, further comprising rubber end caps being disposed on ends of said rack member.

8. The apparatus of claim 7, further comprising a polymeric cover being disposed on said rack member.

* * * * *